US005478126A

United States Patent [19]

Laesch

[11] Patent Number: 5,478,126

[45] Date of Patent: Dec. 26, 1995

[54] VEHICLE STORAGE COMPARTMENT LATCH ASSEMBLY WITH ANTI-RATTLE DEVICE

[75] Inventor: Mark E. Laesch, Eastpointe, Mich.

[73] Assignee: Chrysler Corporation, Highland Park, Mich.

[21] Appl. No.: 169,247

[22] Filed: Dec. 20, 1993

[51] Int. Cl.[6] ..... E05C 19/06

[52] U.S. Cl. ..... 292/87; 292/DIG. 38; 292/DIG. 73

[58] Field of Search ..... 292/DIG. 72, DIG. 73, 292/198, DIG. 38, 87, 219, DIG. 30, 203

[56] References Cited

U.S. PATENT DOCUMENTS

| | | | |
|---|---|---|---|
| 545,277 | 8/1895 | Feinberg | 292/80 |
| 1,535,138 | 4/1925 | Thomas . | |
| 1,892,613 | 12/1932 | Edgin . | |
| 3,313,564 | 4/1967 | Pultz | 292/87 |
| 4,416,477 | 11/1983 | Bialobrzeski et al. | 292/DIG. 38 X |
| 4,470,626 | 9/1984 | Gergoe et al. | 292/341.12 |
| 4,542,924 | 9/1985 | Brown et al. | 292/DIG. 38 X |
| 4,676,544 | 6/1987 | Dabringhaus et al. | 296/37.9 |
| 4,951,984 | 8/1990 | Huang | 292/DIG. 38 X |
| 5,188,403 | 2/1993 | Anderson | 292/DIG. 38 X |

FOREIGN PATENT DOCUMENTS

| | | | |
|---|---|---|---|
| 2730913 | 11/1978 | Germany | 292/87 |
| 1542906 | 3/1979 | United Kingdom | 292/87 |

*Primary Examiner*—Rodney M. Lindsey
*Attorney, Agent, or Firm*—Christopher A. Taravella

[57] ABSTRACT

A vehicle storage compartment includes a door hingedly mounted thereon, with a latch assembly mounted on the door and cooperable with a latch opening in the storage compartment. The latch assembly includes a mounting bracket and a handle interconnected by a pair of flexible straps, a latch extension formed on the handle, an opening formed in the mounting bracket, and a latch spring having a fixed end secured to an edge of the opening, and a downward bend portion extending from the fixed end to a free distal end, adapted to contact a fixed surface and become compressed when the door is closed to prevent the door from rattling under vehicle operation.

2 Claims, 3 Drawing Sheets

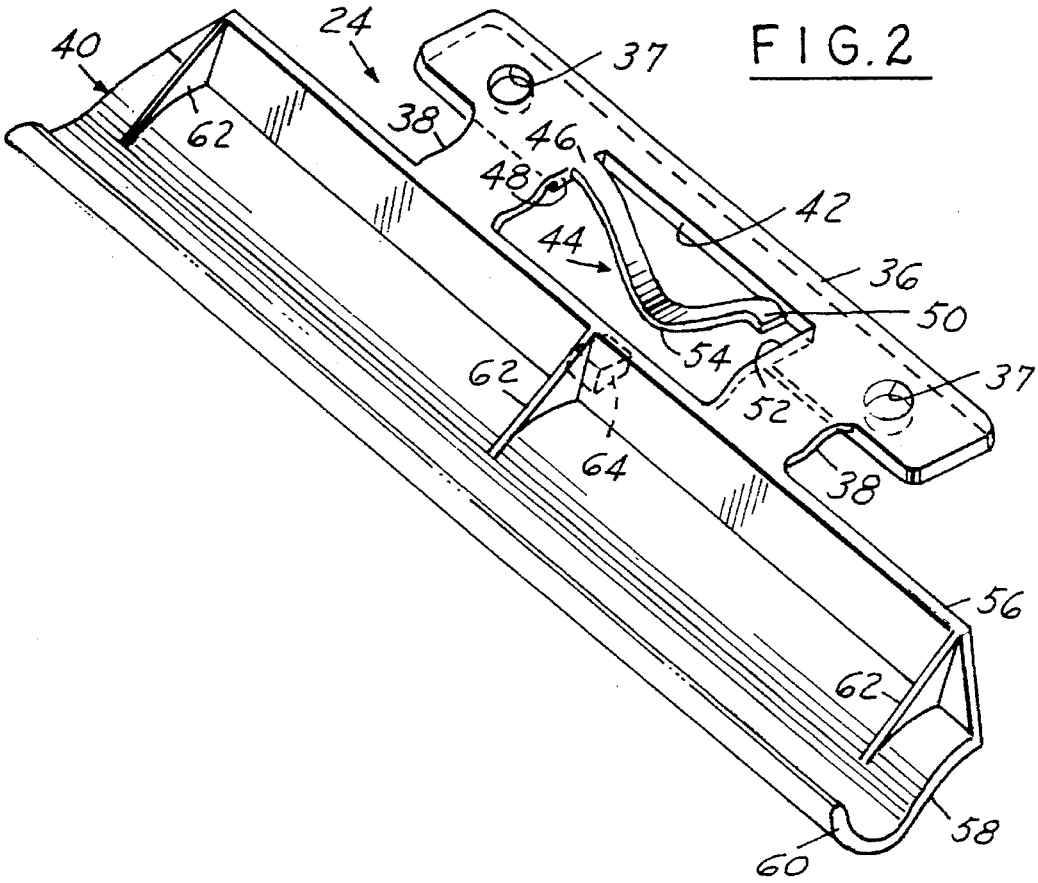
FIG.2
FIG.3
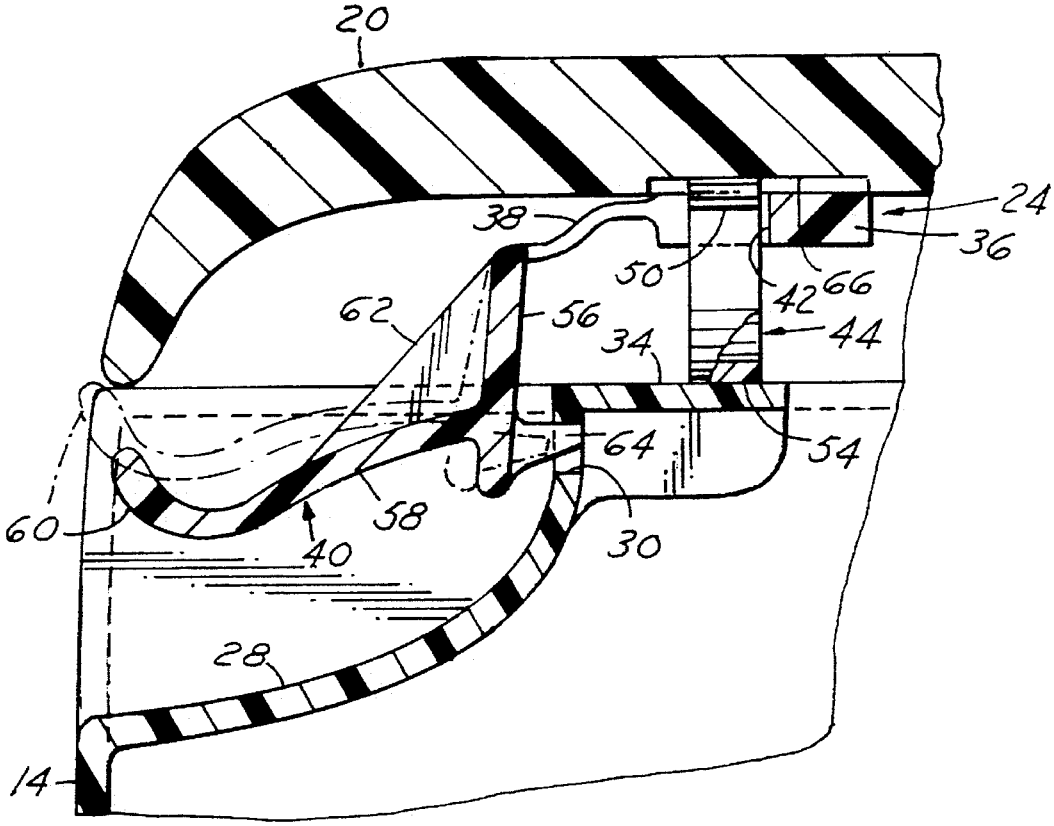

6
6
16
16
16
16
20
20
22
26
26
26
26
38
38
50
50
54
54
30
34
34
44
46
46
36
62
62
62
62
64
66
58
60
60
28
28
14
14

VEHICLE STORAGE COMPARTMENT LATCH ASSEMBLY WITH ANTI-RATTLE DEVICE

TECHNICAL FIELD

This invention relates generally to vehicle storage compartments and, more particularly, to an anti-rattle device for the door of the storage compartment.

BACKGROUND ART

Heretofore, many vehicle side storage compartments for vehicles, such as minivans and other recreational vehicles, have included doors or lids with latch assemblies mounted thereon which were prone to rattle as a result of variations in component size and assembly tolerances.

Various prior door latch constructions include Feinberg Pat. No. 545,277; Thomas Pat. No. 1,535,138; Edgin Pat. No. 1,892,613; Gergoe et al Pat. No. 4,470,626; and Dabringhaus et al Pat. No. 4,676,544. Of these, Edgin includes a leaf spring 5, and Dabringhaus et al include an anti-chatter detent spring 12.

DISCLOSURE OF THE INVENTION

A general object of the invention is to provide an improved storage compartment for vehicles.

Another object of the invention is to provide an improved storage compartment, and a door having molded latch assembly including an integral anti-rattle provision.

A further object of the invention is to provide a storage compartment having a door hingedly mounted thereon, with a latch assembly mounted on the door and cooperable with a latch opening in the storage compartment, the latch assembly including a mounting bracket and a handle interconnected by a pair of flexible straps, a latch extension formed on the handle, an opening formed in the mounting bracket, and a latch spring having a fixed end secured to an edge of the opening, and a downward bend portion extending from the fixed end to a free distal end.

These and other objects and advantages will become more apparent when reference is made to the following drawings and the accompanying description.

BRIEF DESCRIPTION OF THE DRAWINGS

FIG. 2 is an enlarged perspective view of a latch assembly portion of the FIG. 1 structure;

FIG. 3 is an enlarged fragmentary cross-sectional view of a portion of the FIG. 1 structure;

BEST MODE OF CARRYING OUT THE INVENTION

Figure 1:
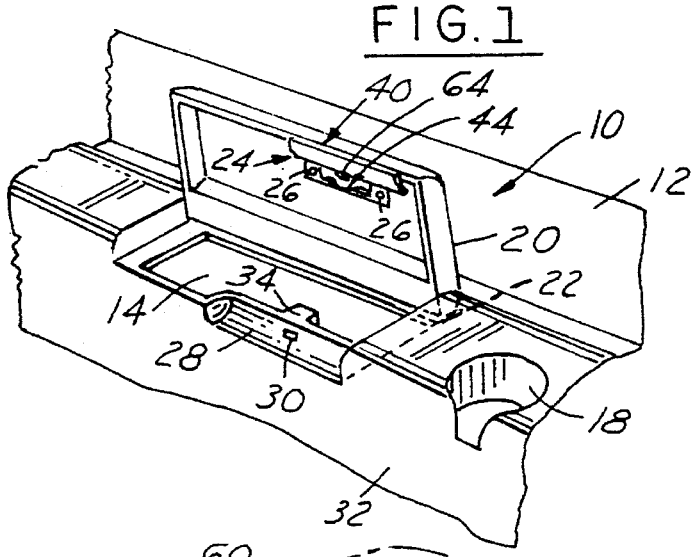
FIG. 1 is a fragmentary perspective view of a vehicle storage compartment embodying the invention.

Referring now to the drawings in greater detail, FIG. 1 illustrates a side compartment 10, such as it typically positioned along the inside wall 12 adjacent the rear seats of a vehicle, such as a minivan, for the convenience of passengers. The compartment 10 includes a storage space 14 formed in a shelf 16, which may additionally include a circular recess 18 suitable for holding a cup (not shown). A door 20, which may include a flexible hinge, represented as 22, is adapted to form an extension of the plane of the shelf 16 when closed.

A latch assembly 24 is secured by fasteners 26 to a front inside edge portion of the door 20. An arcuate-shaped recess 28 including a latch opening 30 is formed in an upper, outer edge portion of a wall 32 of the compartment 10, in vertical alignment with the latch assembly 24. A flat surface 34 is formed on the upper edge of the storage space 14, in lateral alignment with the latch opening 30, for a purpose to be described.

As shown in FIG. 2, the latch assembly 24 includes a mounting bracket 36 having two holes 37 formed therein for receiving the fasteners 26 (FIG. 1), dual spaced-apart flexible straps 38 connected between the mounting bracket 36 and a longitudinally extending actuating handle 40. A rectangular opening 42 is formed between the flexible straps 38 and in a central portion of the mounting bracket 36. A flexible spring 44 is integrally molded in the latch assembly 24 such that it is secured at one end 46 thereof to a side edge 48 of the rectangular opening 42, with a free distal end 50 thereof extending toward the opposite side edge 52 of the opening 42, and having a downwardly extending bend 54 formed in the central portion thereof.

The handle 40 is formed to include a rear straight wall 56, a lower substantially concave-shaped wall 58, and an arcuate-shaped front wall 60 extending upwardly toward the peripheral edge of the door 20. A plurality of three-sided braces 62 are integrally molded between the rear wall 56 and the concave-shaped wall 58. A latch extension 64 is formed on the outer surface of the rear straight wall 56 below the lateral center line of the rectangular opening 42, in lateral alignment with the center of the bend 54 of the flexible spring 44.

In operation, when the door 20 of FIG. 1 is closed about the flexible hinge 22, it assumes the condition shown in FIG. 3. That is, the handle 40 is caused to pivot upwardly about the flexible straps 38 when the latch extension 64 contacts the upper edge of the arcuate-shaped recess 28 to move down to where the latch extension 64 snaps into the latch opening 30, to hold the door 20 closed.

Concurrently, the bend 54 of the flexible spring 44 contacts the flat surface 34 and is thereby pushed upwardly under compression, urging the free end 50 into engagement with a surface 66 (FIGS. 3 and 5) on the inner surface of the door 20, retaining the door 20 in a tightly closed condition and preventing any tendency to rattle during subsequent driving conditions of the vehicle.

Figure 4:
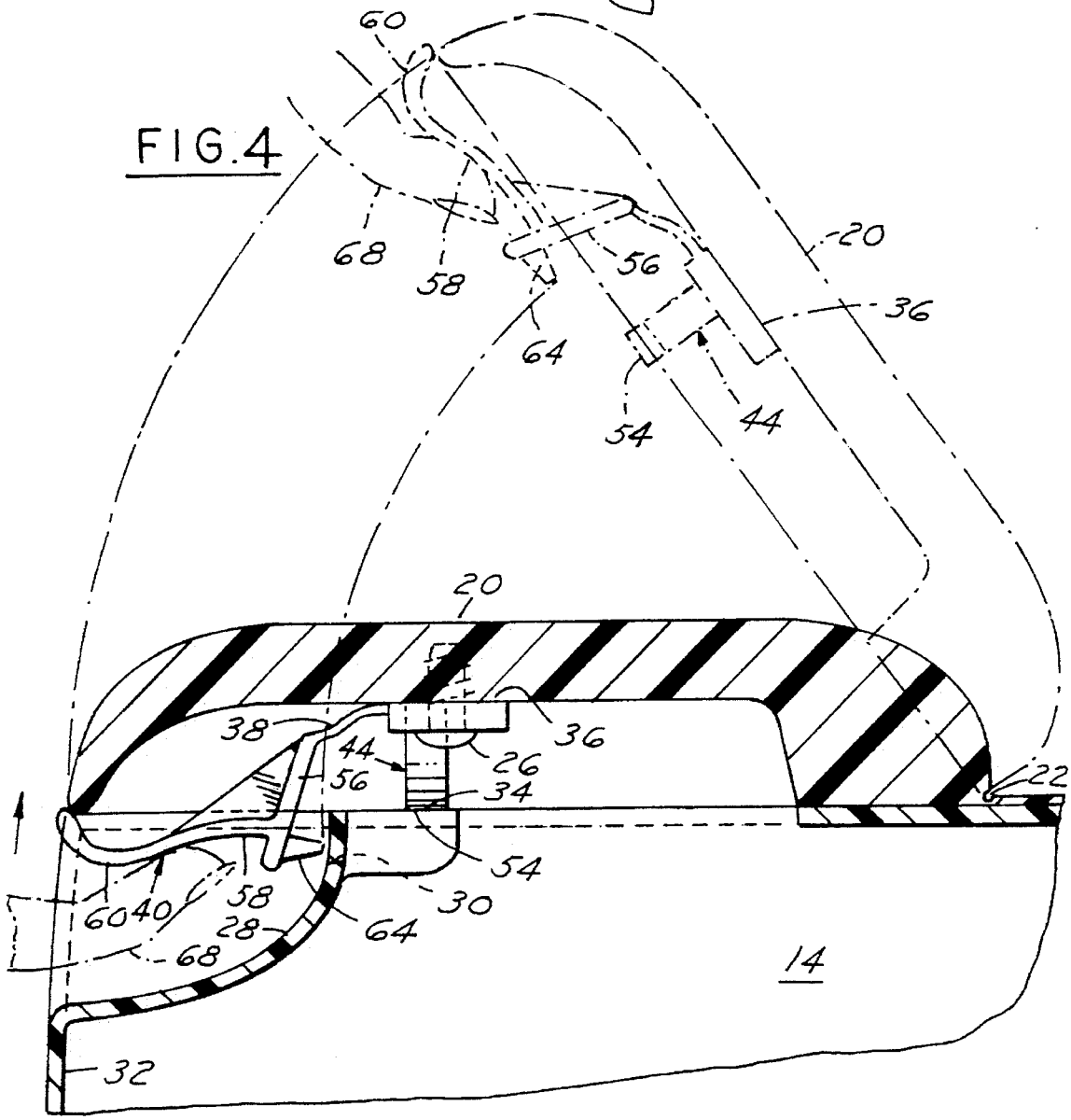
FIG. 4 is a view similar to FIG. 3, illustrating an operational mode of the invention.

As indicated in FIG. 4, to open the door 20 for access to the storage space 14, the user inserts one or more fingers 68 into the arcuate-shaped recess 28 to engage the lower concave-shaped wall 58 and lift same, to thereby flex about the flexible straps 38 and pull the latch extension 64 out of the latch opening 30, and free the door 20 to be lifted upwardly about its flexible hinge 22.

Figures 5, 6:
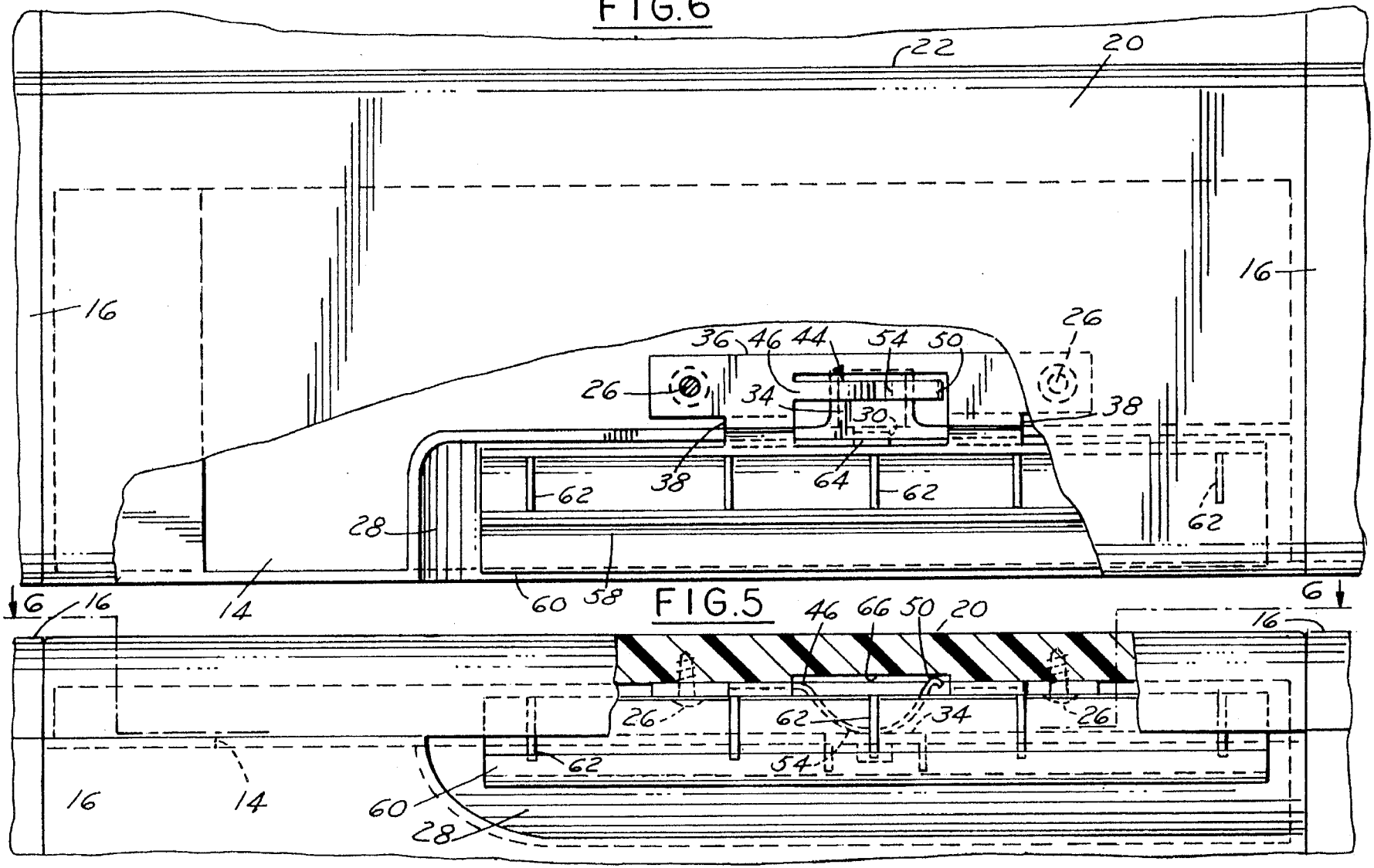
FIG. 5 is an enlarged side elevational view, in partial cross-section, of the FIG. 1 structure.
FIG. 6 is a top view, in partial cross-section, taken along the plane of the line 6—6 of FIG. 5, and looking in the direction of the arrows.

FIGS. 5 and 6 are broken-away front and top views of the door 20 and the latch assembly 24 in the closed condition.

INDUSTRIAL APPLICABILITY

It should be apparent that the invention provides an improved vehicle storage compartment wherein novel means are provided for preventing rattling of the compartment door during operation of the vehicle.

It should be further apparent that the invention provides a compact, readily moldable, and inexpensive means for preventing storage compartment doors or lids from rattling when used in vehicles such as minivans and other recreational vehicles.

While but one embodiment of the invention has been shown and described, other improvements are possible within the scope of the following claims.

What is claimed

1. For use in a vehicle, a storage compartment including a storage space adapted to be closed by a hinged door having a latch assembly mounted on an inner surface thereof and including a latch extension for cooperation with a latch opening formed in an outer wall of the compartment when the door is closed, the improvement comprising a flexible spring having one end thereof integrally molded in the latch assembly and including an intermediate bend and a free distal end extending therefrom, and a flat surface formed at an upper edge of the storage space for engagement by said bend when the door is closed, to thereby urge said distal end into engagement with said inner surface of said hinged door to prevent rattling of the door during operation of the vehicle.

2. In a latch assembly for use between a door and a storage compartment, the latch assembly being molded to include a mounting bracket for securing to an inner portion of the door, a handle connected to the mounting bracket and having a latch extension formed thereon for locking cooperation with a latch opening formed in an outer surface of the storage compartment, the improvement comprising a rectangular opening formed in the mounting bracket, a latch spring formed to have one end thereof secured to an edge of the rectangular opening and a free end extending toward the opposite edge, with a downwardly extending bend portion formed between the ends thereof, and a fixed surface formed on the upper edge of the storage compartment adapted to be engaged by the bend portion to flex the latch spring so as to cause said free end to engage said inner edgeportion of said door and thereby compress and retain said latch spring confined between said door and said flat surface to prevent the door from rattling.

* * * * *